US010281833B2

(12) United States Patent
Kinokuni

(10) Patent No.: US 10,281,833 B2
(45) Date of Patent: May 7, 2019

(54) IMAGE FORMING APPARATUS

(71) Applicant: CANON KABUSHIKI KAISHA, Tokyo (JP)

(72) Inventor: Jiro Kinokuni, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 10 days.

(21) Appl. No.: 15/784,372

(22) Filed: Oct. 16, 2017

(65) Prior Publication Data

US 2018/0107135 A1 Apr. 19, 2018

(30) Foreign Application Priority Data

Oct. 17, 2016 (JP) ..... 2016-203392
Jul. 27, 2017 (JP) ..... 2017-145260

(51) Int. Cl.
*G03G 15/00* (2006.01)
*G03G 15/02* (2006.01)

(52) U.S. Cl.
CPC ..... *G03G 15/0266* (2013.01); *G03G 15/5037* (2013.01); *G03G 2215/00569* (2013.01)

(58) Field of Classification Search
None
See application file for complete search history.

(56) References Cited

U.S. PATENT DOCUMENTS 7,945,183 B2 5/2011 Tomiie et al.
9,545,786 B2 * 1/2017 Tang ..... G03G 15/266
2004/0234300 A1 * 11/2004 Okamura ..... G03G 15/065 399/285
2006/0133837 A1 * 6/2006 Shimojo ..... G03G 21/0005 399/71
2008/0038017 A1 * 2/2008 Fujita ..... G03G 15/0233 399/175
2009/0142101 A1 * 6/2009 Kosuge ..... G03G 15/5033 399/237
2010/0239286 A1 * 9/2010 Hanashi ..... G03G 15/0266 399/50
2012/0057912 A1 * 3/2012 Hasegawa ..... G03G 21/0094 399/346

FOREIGN PATENT DOCUMENTS

JP 06-202446 A 7/1994
JP 10-232534 A 9/1998
JP 2009-103829 A 5/2009

* cited by examiner

*Primary Examiner* — Sevan A Aydin
(74) *Attorney, Agent, or Firm* — Venable LLC

(57) ABSTRACT

An image forming apparatus includes an image bearing member, a charging roller, a toner image forming portion, a voltage source, a detecting member, a controller, and a test executing portion configured to execute an operation in a test mode in which in a period in advance of the image forming period, a plurality of test AC voltages having a test peak-to-peak voltage with different frequencies are successively applied to the charging roller and alternating currents are detected by the detecting member. The test executing portion sets a predetermined peak-to-peak voltage on the basis of a specific frequency which is a maximum frequency at which a relationship between the frequencies and the alternating currents acquired in the operation in the test mode maintains linearity.

10 Claims, 8 Drawing Sheets

IMAGE FORMING APPARATUS

FIELD OF THE INVENTION AND RELATED ART

The present invention relates to an image forming apparatus, such as a copying machine, a printer or a facsimile machine, having a function of forming an image on a recording material (medium) such as a sheet.

As a charging bias voltage applied to a charging roller, a voltage in the form of a DC voltage (Vdc) biased with an AC voltage having a peak-to-peak voltage (Vpp) which is not less than twice a discharge start voltage during application of the DC voltage is used.

Damage and abrasion of a photosensitive drum surface generated by friction between the photosensitive drum surface and a cleaning blade correlates with a discharge current amount. Therefore, Japanese Laid-Open Patent Application (JP-A) Hei 10-232534 proposes control (discharge current control) carried out during non-image formation in order to determine an AC voltage (peak-to-peak voltage) at which a discharge current necessary during image formation is generated. On the other hand, as a resistance-adjusting agent of the charging roller, an ion-conductive agent for which adjustment of a resistance value is relatively easy is used in many cases, but there is a high tendency that environment (temperature, humidity) dependency of the resistance value is high.

Further, in the case where the ion-conductive agent is used as the resistant-adjusting agent, charge transfer at normal temperature is active, but temperature transfer power at low temperature extremely lowers. In such a low-temperature environment, it turned out that there is a case that conventional discharge current control is unsuitable as described below.

FIGS. 7 and 8 are graphs showing relationships between an AC voltage and a discharge current in a normal temperature environment (22° C.) and a low temperature environment (15° C.), respectively. Here, a frequency of the AC voltage is 1.8 kHz.

As shown in FIG. 8, the discharge current shows an unstable characteristic, in some cases, such that in the low temperature environment, the discharge current does not necessarily increase monotonically with an increase of the AC voltage but once decreases and then increases. The cause that the characteristic of the discharge current versus the AC voltage is unstable is not clear, but would be considered because in the low temperature environment, a change of a speed of an electric field in the charging roller is influenced by mobility of a molecular chain in a material of the charging roller and therefore a time required that ions exhibit electroconductivity is long.

In the case where the conventional discharge current control is used in the low temperature environment as described above, a single peak-to-peak voltage cannot be determined in some instances. Therefore, a target discharge current was set in advance at a high value (for example, 35 μA in the low temperature environment although the target discharge current at normal temperature is 25 μA), so that generation of image defect was suppressed. However, the discharge current was set at the high value, and therefore, there was a possibility that the photosensitive drum and the charging roller were deteriorated more than necessary.

Further, conventionally, in order to prevent image non-uniformity at a charging frequency pitch from being conspicuous, in an image forming apparatus in which a process speed was high (fast), a frequency has been set at a high value.

FIGS. 9 and 10 are graphs showing relationships between the AC voltage and the discharge current in the case where the frequency of the AC voltage applied to the charging roller is low (1.8 kHz) and in the case where the frequency of the AC voltage applied to the charging roller is high (2.5 kHz), respectively, in a normal-temperature/low humidity environment (22° C./5% RH). As shown in FIG. 10, in the case where the frequency of the AC voltage is high, even in an environment which is not the low temperature environment, the discharge current does not stably increase with an increase of the AC voltage. This would be considered because at a high frequency, also the speed of the change of the electric field in the charging roller is high, and therefore, even in the normal temperature environment, an electroconductivity generation time of the ions cannot sufficiently catch up with the speed change of the electric field.

Therefore, in some cases, a correspondence relationship between a temperature and a peak-to-peak voltage at which the image defect does not generate was acquired in advance as shown in Table 1 and FIG. 4 and was stored in a memory of an apparatus main assembly, and then a peak-to-peak voltage was set depending on a detection temperature of a temperature sensor in the main assembly.

TABLE 1

(High-Voltage Table A)

| DETECTION TEMPERATURE (° C.) | PEAK-TO-PEAK VOLTAGE (V) |
|---|---|
| 0 | 2306 |
| 2 | 2147 |
| 4 | 2033 |
| 6 | 1952 |
| 8 | 1895 |
| 10 | 1853 |
| 12 | 1824 |
| 14 | 1803 |
| 16 | 1788 |
| 18 | 1777 |
| 20 | 1769 |
| 22 | 1764 |
| 24 | 1760 |
| 26 | 1757 |
| 28 | 1755 |
| 30 | 1753 |

The reason why the image defect can be suppressed even under the low temperature environment by setting the peak-to-peak voltage at a high value would be considered that a moving speed of the ions is increased by further enhancing a maximum electric field and thus also electroconductivity increases.

However, the temperature sensor in the main assembly is generally provided in a place spaced from the charging roller. Further, in the case where a drum cartridge including the charging roller placed in the low temperature environment is mounted in the apparatus main assembly placed in the normal temperature environment or in the reverse case, a detection temperature of the temperature sensor and an actual temperature of the charging roller are different from each other.

For that reason, in some cases, the peak-to-peak voltage set on the basis of a high-voltage table A (Table 1) was excessively low or excessively high, so that there was a possibility of improper charging or a lowering in lifetime of the photosensitive member (photosensitive drum) or the like.

SUMMARY OF THE INVENTION

According to an aspect of the present invention, there is provided an image forming apparatus comprising: an image bearing member; a charging roller configured to electrically charge the image bearing member in contact with the image bearing member; a toner image forming portion configured to form a toner image on the image bearing member by depositing toner on the image bearing member after the charged image bearing member is exposed to light; a voltage source configured to output a voltage in the form of an AC voltage biased with a DC voltage; a detecting member configured to detect an alternating current flowing between the voltage source and the charging roller; a controller configured to control the voltage source in an image forming period so that the image bearing member is charged by applying the voltage having a predetermined frequency and a predetermined peak-to-peak voltage from the voltage source to the charging roller and then the toner image is formed on the image bearing member by the toner image forming portion; and a test executing portion configured to execute an operation in a test mode in which in a period in advance of the image forming period, a plurality of test AC voltages having a test peak-to-peak voltage with different frequencies are successively applied to the charging roller and alternating currents are detected by the detecting member, wherein the test executing portion sets the predetermined peak-to-peak voltage on the basis of a specific frequency which is a maximum frequency at which a relationship between the frequencies and the alternating currents acquired in the operation in the test mode maintains linearity.

Further features of the present invention will become apparent from the following description of exemplary embodiments with reference to the attached drawings.

DESCRIPTION OF EMBODIMENTS

Embodiments of the present invention will be specifically described with reference to the drawings.

First Embodiment (Image Forming Apparatus)

Figure 1:
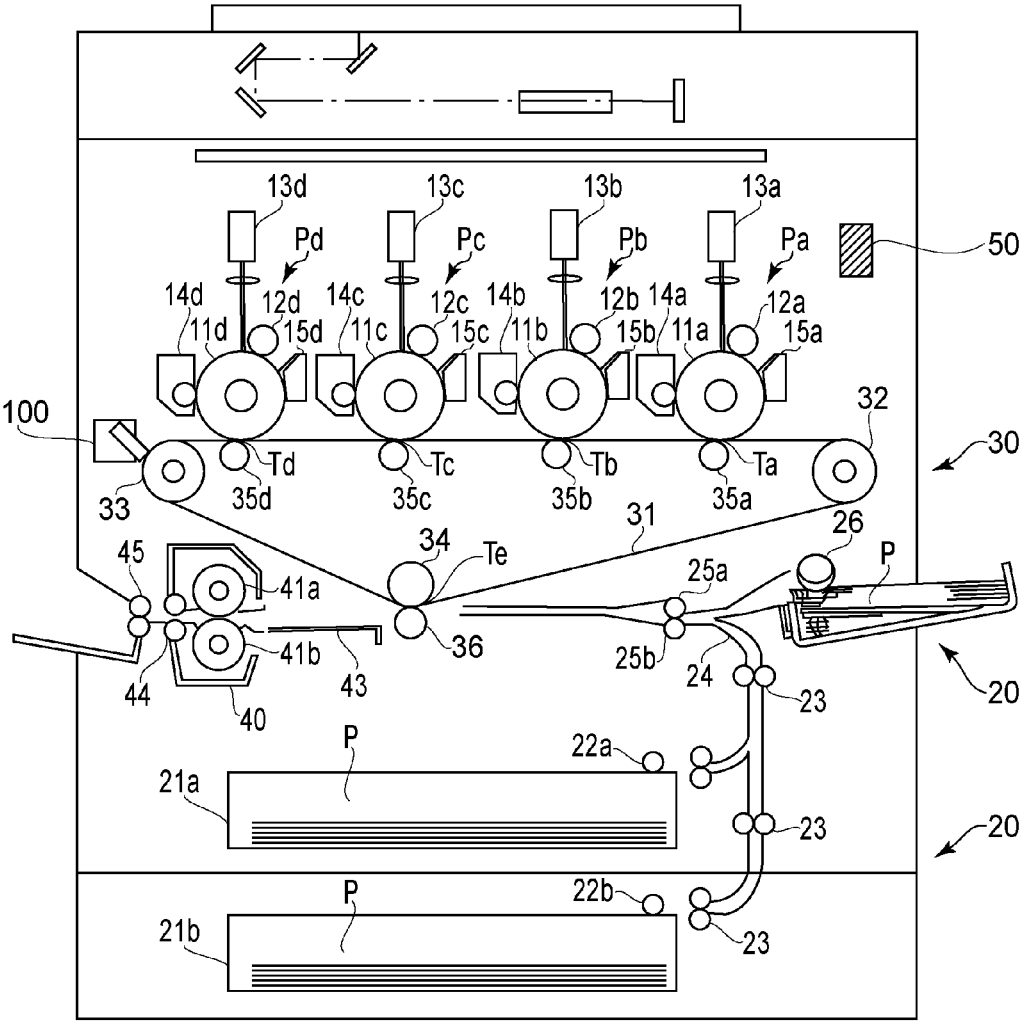
FIG. 1 is a cross-sectional view showing a schematic structure of an image forming apparatus according to an embodiment of the present invention.

FIG. 1 is a cross-sectional view showing a schematic structure of an image forming apparatus according to an embodiment of the present invention. The image forming apparatus shown in FIG. 1 is a four-color-based full-color image forming apparatus in which four image forming units are provided in a tandem manner along a movement direction of an endless belt-type intermediary transfer member which is a toner supporting member (hereinafter, referred to as an intermediary transfer belt).

An image outputting portion roughly includes a toner image forming portion 10 (in which four stations Pa, Pb, Pc and Pd are juxtaposed and have the same constitution), a sheet feeding unit, an intermediary transfer unit 30, a fixing unit 40 and a control unit (not shown). The respective units will be specifically described.

The toner image forming unit includes photosensitive drums 11*a*, 11*b*, 11*c* and 11*d* as image bearing members, and the photosensitive drums 11*a*, 11*b*, 11*c* and 11*d* are shaft-supported at centers thereof and are rotationally driven. Along a rotational direction of the photosensitive drums 11*a*-11*d*, primary charging rollers 12*a*, 12*b*, 12*c* and 12*d*, laser scanner units 13*a*, 13*b*, 13*c* and 13*d*, and developing devices 14*a*, 14*b*, 14*c* and 14*d* are provided opposed to outer peripheral surfaces of the photosensitive drums 1*a*-1*d*, respectively.

In an image forming step, the control unit (controller) causes a voltage source (power source) to apply a charging voltage to the charging rollers 12*a*-12*d*, so that electric charges having a uniform charge amount are given to the surfaces of the photosensitive drums 11*a*-11*d*. Then, the controller carries out formation of electrostatic latent images and formation of toner images by deposition of toners at the toner image forming portion. By the laser scanner units 13*a*-13*d*, the surfaces of the photosensitive drums 11*a*-11*d* are exposed to light beams such as laser beams modulated in response to recording image signals, whereby the electrostatic latent images are formed on the surfaces of the photosensitive drums 11*a*-11*d*. Details of an operation of the laser scanner units will be described later.

Then, developers (hereinafter, referred to as toners) of four colors of yellow, cyan, magenta and black are deposited on the electrostatic latent images by the developing devices 14*a*-14*d* accommodating the developers of the four colors, respectively, so that the electrostatic latent images are visualized as toner images. In sides downstream of image transfer regions Ta, Tb, Tc and Td where the visualized toner images are transferred onto the intermediary transfer member (belt), by cleaning devices 15*a*, 15*b*, 15*c* and 15*d*, the drum surfaces are cleaned by scraping off the toners remaining on the surfaces of the photosensitive drums 11*a*-11*d* without being transferred.

By the above-described process, image forming operations with the respective toners are successively carried out. As the photosensitive drums 11*a*-11*d*, negatively chargeable OPC photosensitive drums were used. Specifically, as a photosensitive member layer, a negatively chargeable organic semiconductor layer (OPC layer) having a 29 μm-thick lamination structure including a CGL (carrier generating layer) formed of an azo pigment and a CTL (carrier transporting layer) formed, on the CGL, of a mixture of hydrozone and a resin material was used.

Next, the cleaning devices 15*a*, 15*b*, 15*c* and 15*d* will be described. As each of the cleaning devices, a cleaning device of a counter blade type is used, and a free length of a cleaning blade is 8 mm. The cleaning blade is an elastic blade principally formed of a urethane material, and is pressed against the photosensitive drum with a linear pressure of about 35 g/cm.

The sheet feeding unit 20 includes cassettes 21*a* and 21*b* and a manual feeding tray 27 for accommodating recording materials P. The sheet feeding unit 20 further includes pick-up rollers 22*a*, 22*b* and 26 for sending the recording materials P one by one from the cassettes and the manual feeding tray and includes a sheet feeding roller pair 23 and a sheet feeding guide 24 for feeding the sent recording material P to registration rollers 25*a* and 25*b* for sending the recording material P to a secondary transfer region Te in synchronism with image formation timing of the image forming portion.

Next, the intermediary transfer unit 30 will be specifically described. As a material of the intermediary transfer belt 31, for example, PET (polyethylene terephthalate), PVdF (polyvinylidene difluoride) or the like is used. The intermediary transfer belt 31 is wound around a driving roller 32 for transmitting a driving force (drive) to the intermediary transfer belt 31, a tension roller 33 for imparting a proper tension to the intermediary transfer belt 31 by urging with a spring (not shown), and a follower roller 34 opposing the secondary transfer region Te through the intermediary transfer belt 31.

Of these rollers, between the driving roller 32 and the tension roller 33, a primary transfer flat surface (plane) is formed. The driving roller 32 is prepared by coating a surface of a metal roller with a several mm-thick rubber (of urethane or chloroprene) and prevents a slip with the intermediary transfer belt 31. The driving roller 32 is rotationally driven by a pulse motor (not shown).

In the primary transfer regions Ta-Td where the respective photosensitive drums 11*a*-11*d* oppose the intermediary transfer belt 31, primary transfer rollers 35*a*-35*d* are provided in a back side of the intermediary transfer belt 31. Further, a secondary transfer roller 36 is provided opposed to the follower roller 34, and the secondary transfer region Te is formed by a nip with the intermediary transfer belt 31.

The secondary transfer roller 36 is pressed against the intermediary transfer member (intermediary transfer belt 31) with a proper pressure. On the intermediary transfer belt 31, at a position downstream of the secondary transfer region Te, a brush roller (not shown) for cleaning an image forming surface of the intermediary transfer belt 31 and a residual (waste) toner box for accommodating residual toner are provided. Further, on the intermediary transfer belt 31, a cleaning device 100 for removing secondary transfer residual toner is provided.

The fixing unit 40 includes a fixing roller 41*a* in which a heat source such as a halogen heater is provided, and a pressing roller 41*b* (in some cases, this roller is provided with the heat source) which forms a fixing nip in cooperation with the fixing roller 41*a* and which is pressed against the fixing roller 41*a*. The fixing unit 40 further includes a guide 43 for guiding the recording material (transfer material) P to the fixing nip, and an inner sheet-discharging roller 44 and an outer sheet-discharging roller 45 which are used for further discharging the recording material P to an outside of the image forming apparatus.

The control unit (controller) is comprised of a control substrate (board) for controlling operations of mechanisms in the respective units, and a motor drive substrate (not shown) and the like. Further, an environment sensor (e.g., a temperature sensor (temperature detecting member), a temperature and humidity sensor) 50 is provided at a position indicated in FIG. 1 so as to be capable of accurately measuring ambient (environmental) temperature and humidity in the image forming apparatus without being influenced by the fixing unit 40 or the like which is the heat source in the image forming apparatus.

It is difficult to dispose the environment sensor 50 in the neighborhood of the charging rollers and, in general, it is disposed in a place considerably spaced from the charging rollers. That is, placement thereof at a periphery of consumable parts, such as the drum cartridges (the photosensitive drums and the process means), which are frequently exchanged leads to a high possibility of contamination and breakage, so that a risk of breakage and erroneous detection is increased. Therefore, in many cases, the environment sensor 50 is disposed, as a target place, in a place where the consumable parts are mounted and demounted.

Various parts of control are carried out on the basis of an output of this environment sensor 50. Incidentally, as a characteristic of the toners for the colors, it is preferable for forming a good image that a weight-average particle size of the toners is 5-8 μm.

(Charging Device)

A constitution of a contact(-type) charging device including the charging rollers 12 in this embodiment of the present invention will be described.

A surface layer of each of the charging rollers 12 is formed in a 1-2 mm thick electroconductive rubber layer in which an electroconductive agent such as carbon black or the like is dispersed and mixed, and a resistance value of the charging roller 12 is adjusted to $10^5$-$10^7$ Ω·cm for preventing charging non-uniformity during the image formation.

Or, a resistance-adjusted layer is coated as a 0.5-1 mm thick layer on a surface of an electroconductive support through injection molding of an ABS resin material adjusted so as to have a resistance value of $10^5$-$10^7$ Ω·cm by incorporating an ion-conductive polymer compound such as a polyether ester amide. Then, on a surface of the resistance-adjusted layer, a protective layer formed of a thermoplastic resin composition in which electroconductive fine particles such as tin oxide fine particles is formed.

As the electroconductive support for applying a charging voltage thereto, a metal shaft member is used. This shaft member is integrally constituted by a bearing portion, a voltage-application bearing portion and a coating portion of 14 mm in outer diameter. On a peripheral surface of the coating portion, a resistance-adjusted layer of $10^5$-$10^7$ Ω·cm in volume resistivity, formed of an ABS resin material which is a thermoplastic resin material incorporating an ion-conductive polymeric compound such as polyether ester amide is coated and molded in a thickness of 0.5-1 mm through injection molding.

(Cartridge)

The charging roller 12*a*, the photosensitive drum 11*a* and the photosensitive member cleaning portion 15*a* exist as an integral cartridge. By exchanging the cartridge, the charging roller 12*a*, the photosensitive drum 11*a* and the photosensitive member cleaning portion 15*a* can be exchanged altogether as consumables. There are various forms of the cartridge from the form in which the cartridge is exchanged by a service person to the form in which the cartridge is exchanged by a user himself (herself), but the cartridge used in this embodiment can be exchanged by the user himself (herself). An exchange procedure or the like is displayed on a display provided on the main assembly of the image forming apparatus.

The photosensitive drum 11*a* is an organic photosensitive drum having a lamination structure in which an undercoat layer, a charge generating layer, and a charge transporting layer are formed on a support in the listed order. As the support, a material which has electroconductivity and which does not have an influence on measurement of hardness can be used with no particular limitation. For example, a support molded in a drum shape with metal or an alloy, such as aluminum, copper, chromium, nickel, zinc or stainless steel, can be used.

The undercoat layer is formed for the purposes of improvement in adhesive property of the photosensitive layer, improvement in coating property of the photosensitive layer, protection of the support, coating of a defective portion on the support, improvement in charge injection property from the support, protection of the photosensitive layer from electrical breakdown and the like. As a material of the undercoat layer, it is possible to use polyvinyl alcohol, poly-N-vinylimidazole, polyethylene oxide, ethyl cellulose, ethylene-acrylate copolymer, casein, polyamide, and N-methoxymethylated-6-nylon. Or, it is possible to use copolymer nylon, glue, gelatin and the like.

At least one of these materials is dissolved in an appropriate solvent and is applied onto the support. At that time, as a thickness of the undercoat layer, 0.1-2 μm is preferred. Then, the photosensitive layer is formed on the undercoat layer. In the case where a lamination-type photosensitive layer in which the photosensitive layer is function-separated into the charge generating layer and the charge transporting layer and these layers are laminated is formed, on the undercoat layer, the charge generating layer and the charge transporting layer are laminated in a named order.

Here, as a charge generating substance used for the charge generating layer, it is possible to cite selenium-tellurium alloy, pyrylium dyes, thiapyrylium dyes, and various metal complexes having center metals or various crystal systems. Specifically, it is possible to use phthalocyanine compounds having crystal forms such as α, β, γ, ε and X, and pigments such as antanthrone pigments, dibenzpyrene-quinone pigments, pyranthrone pigments, triazo pigments, diazo pigments, and monoazo pigments. Or, it is possible to use indigo pigments, quinacridone pigments, asymmetric quinocyanine pigments, quinocyanine pigments, and amorphous silicon disclosed in JP-A Sho 54-143645.

in this embodiment, the charge generating layer using the phthalocyanine compound capable of enhancing sensitivity for realizing a high image quality was used.

(Block Circuit)

Figure 6:
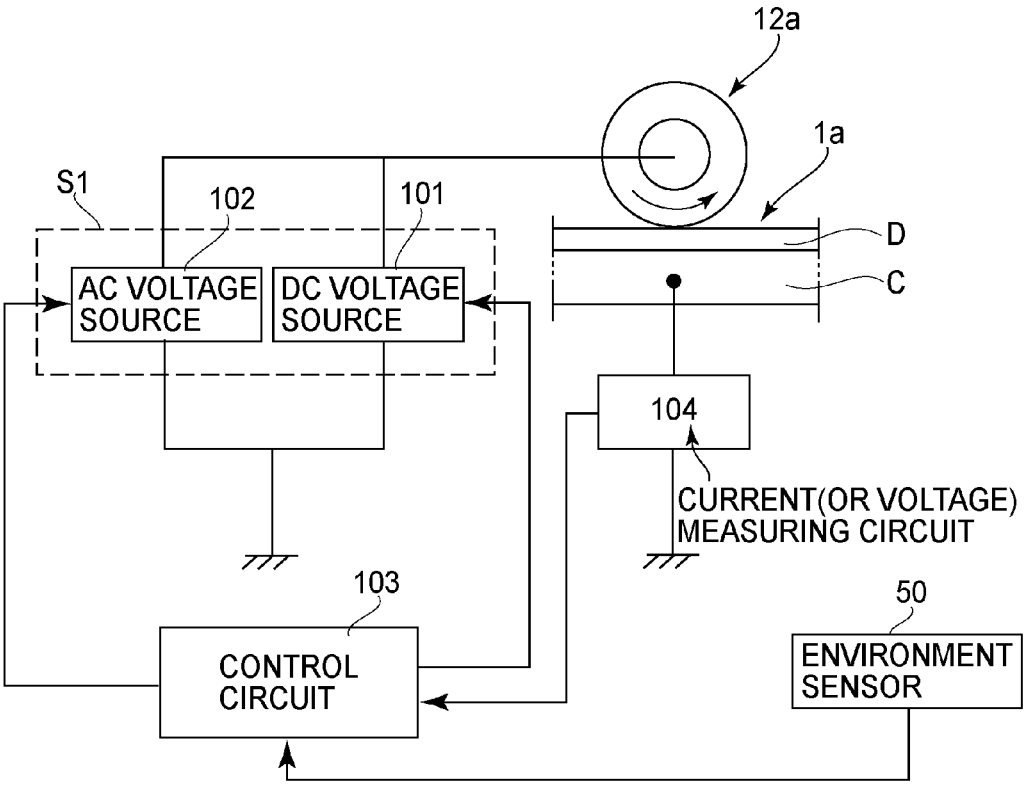
FIG. 6 is a high-voltage block diagram in the embodiment of the present invention.
Figure 7:
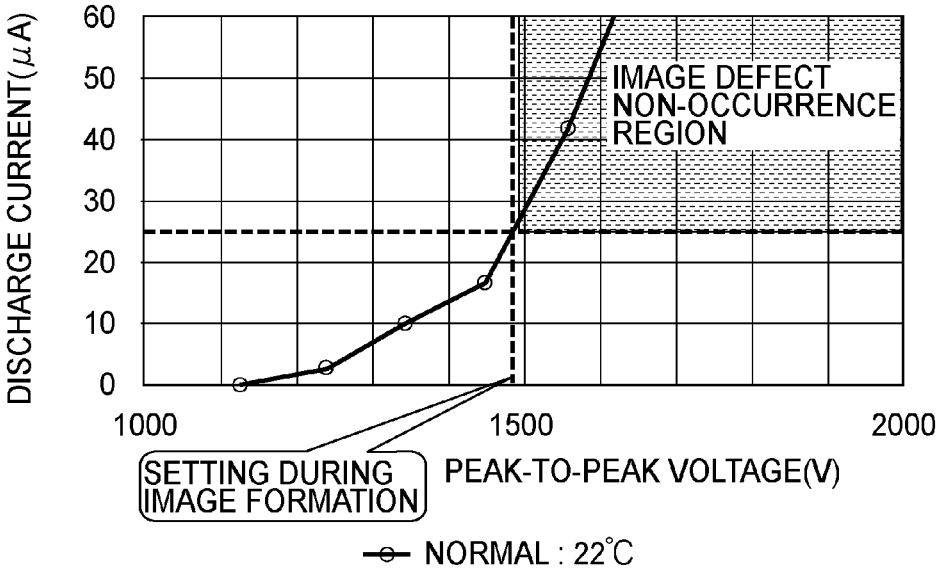
FIG. 7 is a graph showing a relationship between the peak-to-peak voltage and a discharge current amount in a normal temperature environment.
Figure 8:
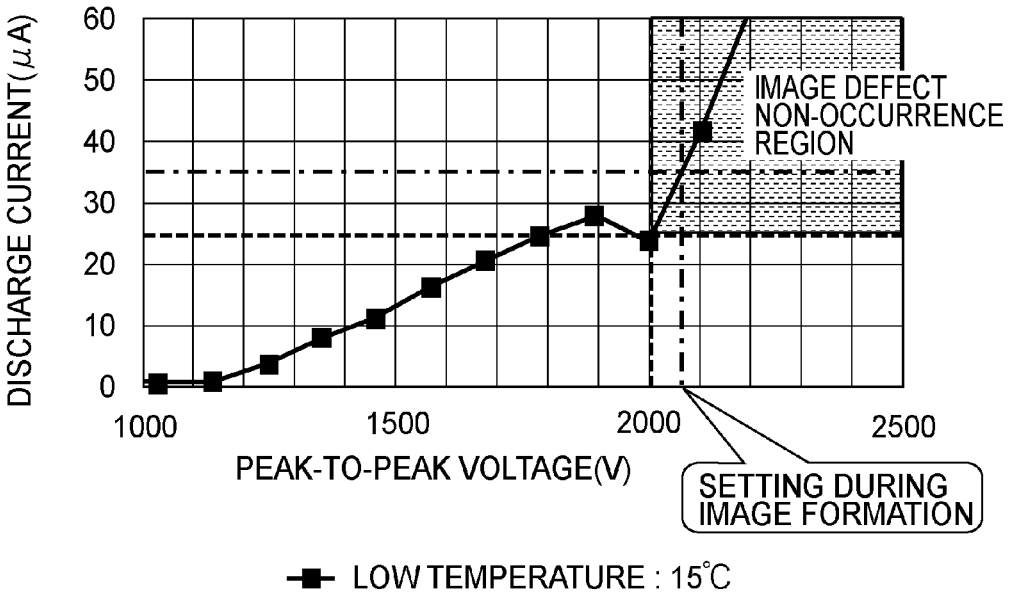
FIG. 8 is a graph showing a relationship between the peak-to-peak voltage and a discharge current amount in a low temperature environment.
Figure 9:
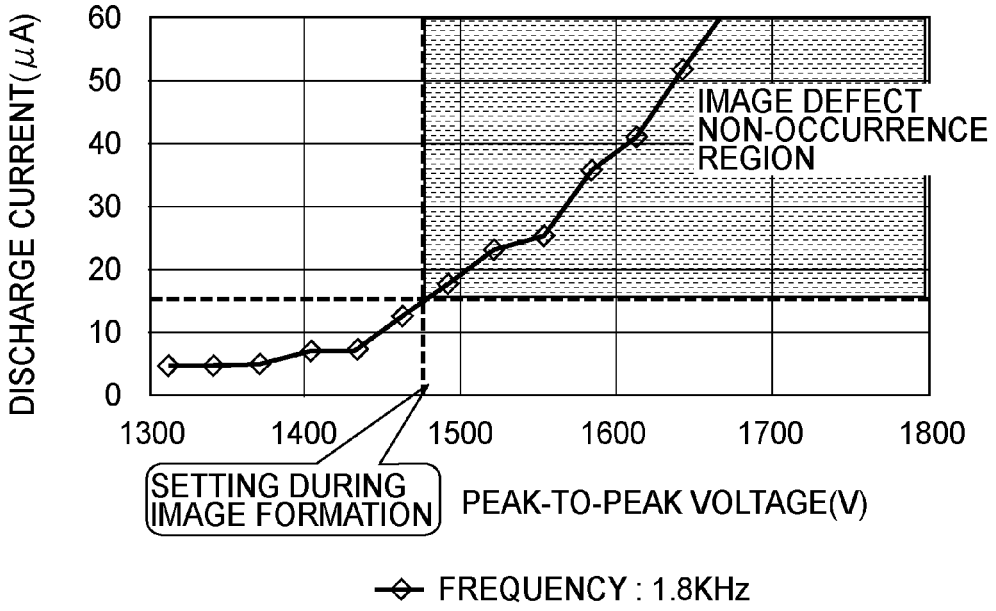
FIG. 9 is a graph showing a relationship between the peak-to-peak voltage and the discharge current amount in a condition of a frequency of 1.8 kHz.
Figure 10:
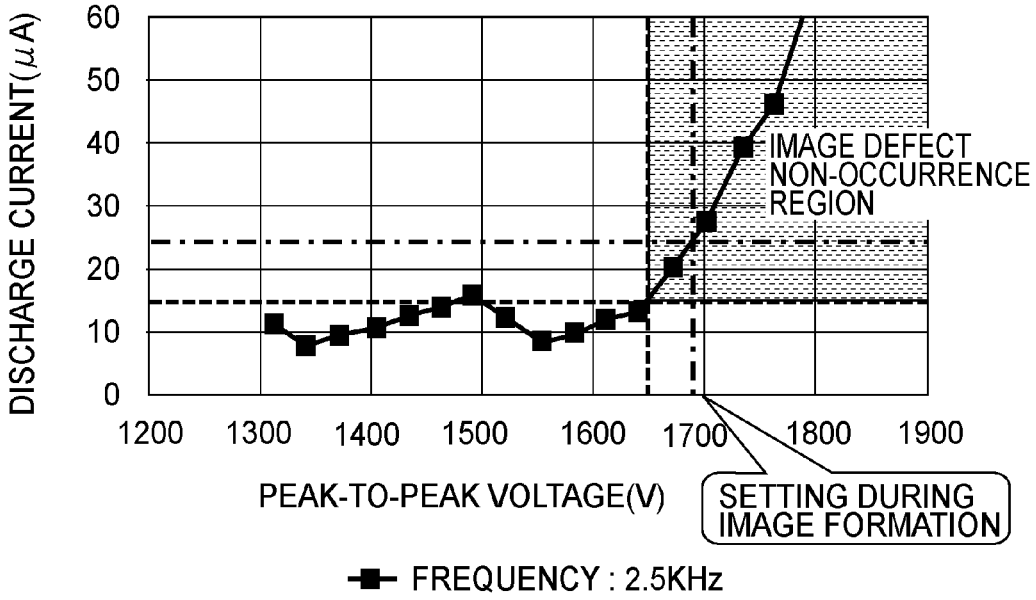
FIG. 10 is a graph showing a relationship between the peak-to-peak voltage and the discharge current amount in a condition of a frequency of 2.5 kHz.

Next, a block circuit of an application system of the charging bias to the charging roller 2 (12*a*) in this embodiment will be described with reference to FIG. 6. An oscillating voltage (bias voltage: Vdc+Vac) in the form of a DC voltage biased with an AC voltage having a frequency f is applied from a voltage source S1 to the charging roller 12*a* through a core metal, so that the peripheral surface of the rotating photosensitive drum 1*a* is electrically charged to a predetermined potential. The voltage source S1 includes a DC voltage source 101 and an AC voltage source 102. A control circuit (controller, CPU) 103 has a function of carrying out ON/OFF control of the DC voltage source 101 and the AC voltage source 102 so that either one of the DC voltage and the AC voltage or the oscillating (superposed) voltage of these voltages is applied to the charging roller 12*a*. Further, the control circuit 103 also has a function of controlling a value of the DC voltage applied from the DC voltage source 101 to the charging roller 12*a* and a value of the AC voltage applied from the AC voltage source 102 to the charging roller 12*a*. An alternating current measuring circuit 104 is used as a (detecting) member for detecting an effective value of an alternating current flowing through the charging roller 12*a* via the photosensitive member 1*a*. From the alternating current measuring circuit 104, a measured alternating current value is inputted to the control circuit 103.

(Test Mode)

Figure 2:
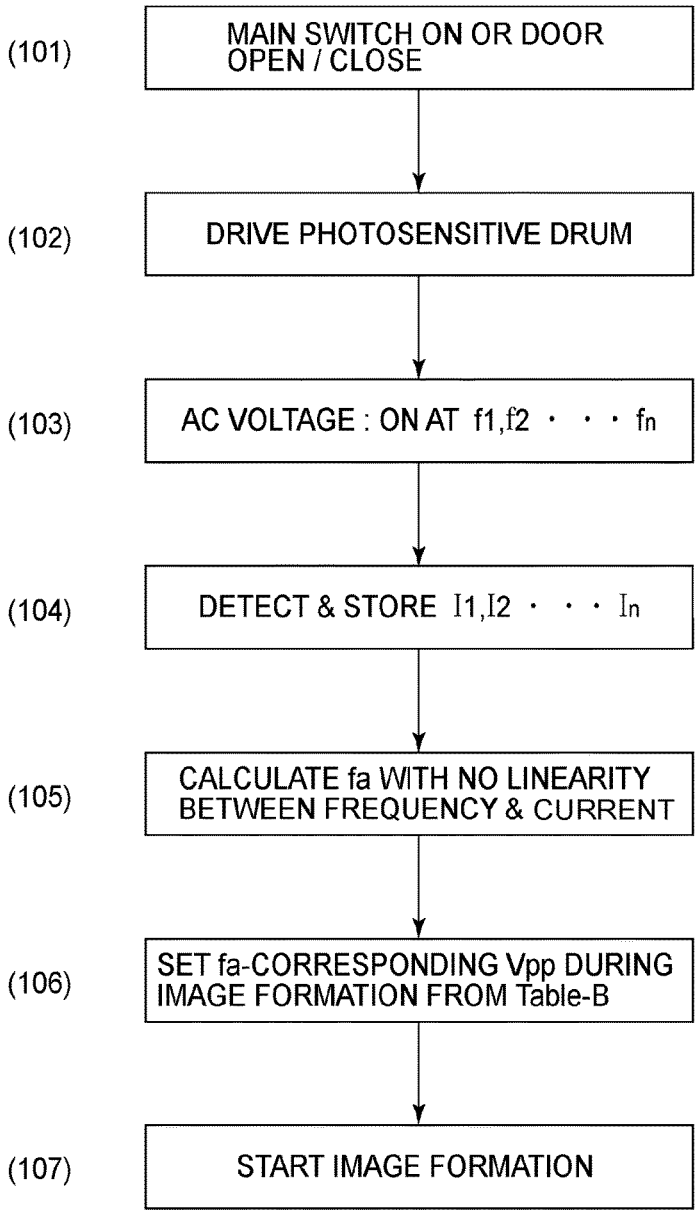
FIG. 2 is a flowchart of the embodiment of the present invention.

In the following, a test mode in this embodiment will be described. In this embodiment, an operation in the test mode is executed in a period in advance of an image forming period. In the operation in the test mode, the test executing portion successively applies, to the charging roller 2*a*, a plurality of test AC voltages having a test peak-to-peak voltage with different frequencies and detects alternating currents by the detecting member. The test executing portion sets a predetermined peak-to-peak voltage on the basis of a specific frequency which is a maximum frequency at which a relationship between the frequencies and the alternating currents acquired in the operation in the test mode maintains linearity. First, a flowchart of FIG. 2 will be described.

A charging frequency during the image formation in this embodiment is 1.8 kHz. A frequency range of the AC voltage applied in the operation in the test mode is determined in advance from a range of the resistance of the charging roller in consideration of an environment and durability. The operation in the test mode is carried out at timing other than during the image formation. In a step (101) shown in FIG. 2, a main switch of the main assembly of the image forming apparatus is turned on or a door is opened or closed, and in a step (102), the photosensitive drum is driven. Then, in a step (103), the test peak-to-peak voltage is fixed to 600 V, and the frequency is stepwisely changed from a low frequency to a high frequency, and then in a step (104), alternating currents are detected. Incidentally, the change of the frequency may also be made in a manner such that the frequency is once changed from the low frequency to the high frequency and thereafter is changed to the low frequency again.

Then, in a step (105), the test executing portion determines the specific frequency which is the maximum frequency at which the relationship between the frequencies and the alternating currents acquired in the operation in the test mode maintains linearity. The linear relationship between the frequencies and the alternating currents is maintained in a frequency range (region) in which the specific frequency is the main assembly frequency. When the frequency exceeds the specific frequency, a difference between the linear relationship and the alternating current increases with an increasing frequency. The test executing portion determines, as the specific frequency, the main assembly frequency at which the difference between the linear relationship and the alternating current is less than a predetermined value. As the predetermined value, for example, a value such that with respect to a phantom rectilinear line obtained by extending the linear between in a low frequency range, a difference between the alternating current and an intersection with the phantom rectilinear line at an arbitrary frequency is about 1% to about 3% can be used. As the predetermined value, a fixed value may also be used.

Figure 3:
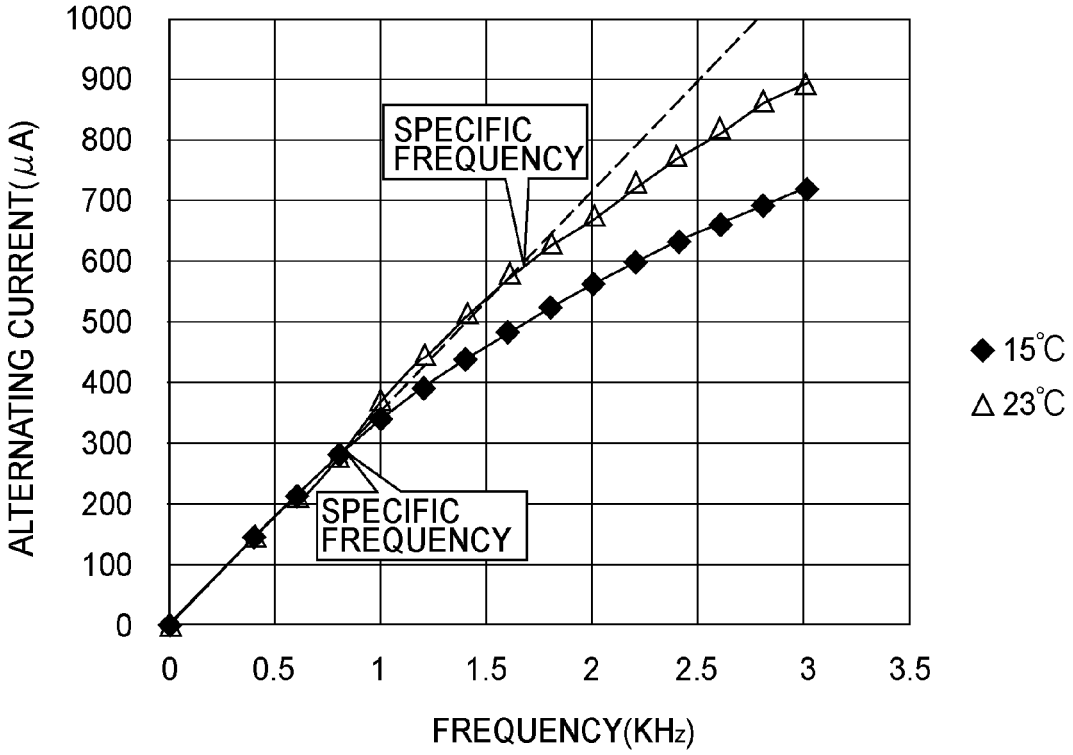
FIG. 3 is a graph showing a relationship between a frequency and an alternating current in the embodiment of the present invention.
Figure 4:
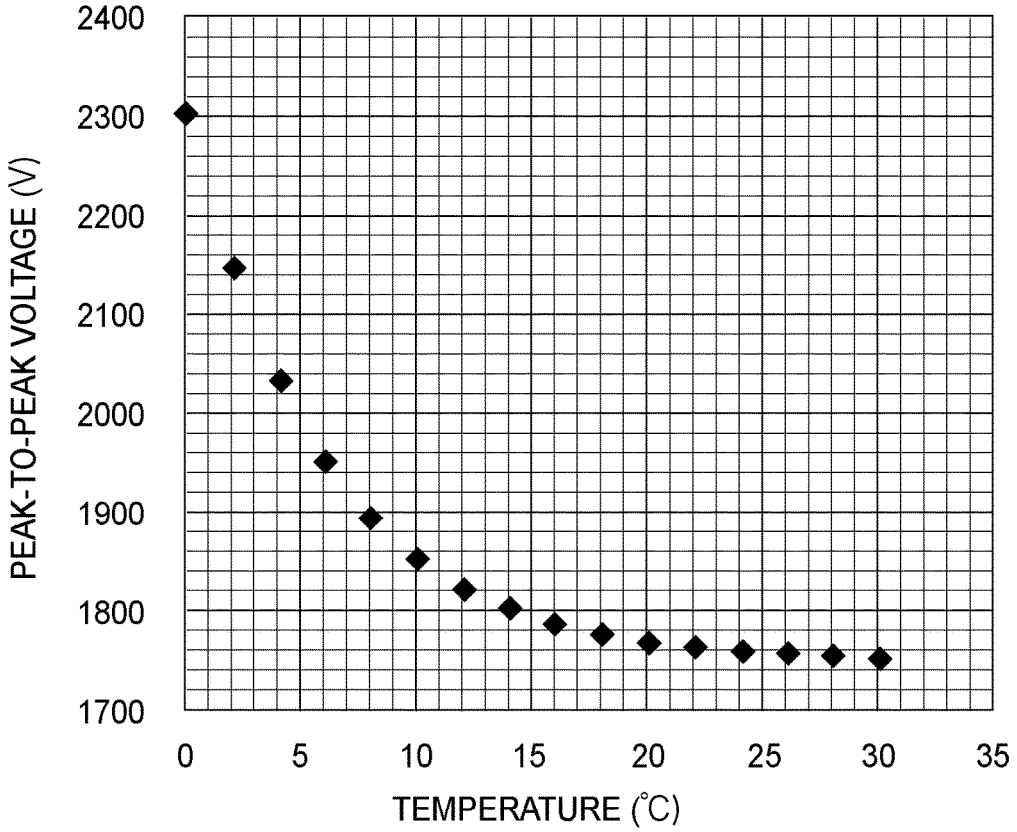
FIG. 4 is a graph showing a relationship between a temperature and a peak-to-peak voltage in conventional control.

An example of the relationship, between the frequency and the alternating voltage in each of a 15° C.-environment and a 23° C.-environment, acquired in the operation in the test mode is shown in FIG. 3. FIG. 3 shows that when the frequency exceeds the specific frequency which is the maximum frequency at which the linear relationship is maintained, a responsiveness of the electric charges in the charging roller to the frequency lowers. According to FIG. 3, it is understood that the specific frequency exists in the neighborhood of 1.7 kHz in the 23° C.-environment and of 0.8 kHz in the 15° C.-environment. Further, in general, there is a tendency that the specific frequency is low when electroconductivity of the charging roller is high and that the specific frequency is high when the electroconductivity is low.

Next, in a step (106), in accordance with a high-voltage table B (Table 2 appearing hereinafter) showing a correspondence relationship of the peak-to-peak voltage versus the specific frequency stored in advance in a storing portion of the main assembly of the image forming apparatus or in accordance with a relationship shown in FIG. 5, the control circuit 103 which is the test executing portion sets a predetermined peak-to-peak voltage applied during the image formation. In the high (AC)-voltage table B (Table 2), the peak-to-peak voltage such that improper charging does not generate under a condition of the charging frequency of 1.8 kHz during the image formation is set. Then, in a step (107), the image formation is started.

Figure 5:
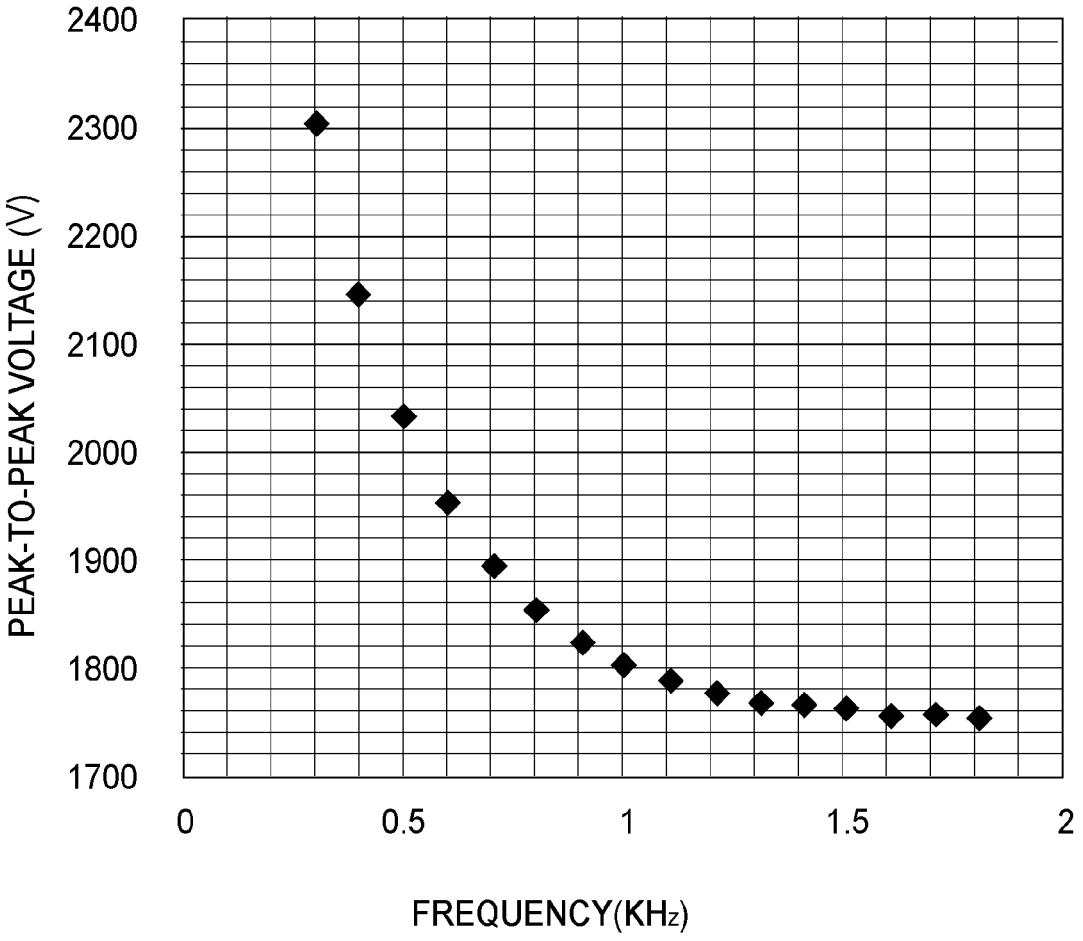
FIG. 5 is a graph showing a relationship between a specific frequency and a peak-to-peak voltage in a test mode in the embodiment of the present invention.

As the predetermined peak-to-peak voltage during the image formation, from the high-voltage table B (Table 2) or FIG. 5 (plotted from Table 2), a voltage of 1755 V in the 23° C.-environment and a voltage of 1853 V in the 15° C.-environment are set, so that a good image free from the improper charging can be obtained.

TABLE 2

(High-Voltage Table B)

| SPECIFIC FREQUENCY (kHz) | PEAK-TO-PEAK VOLTAGE (V) |
|---|---|
| 0.3 | 2306 |
| 0.4 | 2147 |
| 0.5 | 2033 |
| 0.6 | 1952 |
| 0.7 | 1895 |
| 0.8 | 1853 |
| 0.9 | 1824 |
| 1.0 | 1803 |
| 1.1 | 1788 |
| 1.2 | 1777 |
| 1.3 | 1769 |
| 1.4 | 1764 |
| 1.5 | 1760 |
| 1.6 | 1757 |
| 1.7 | 1755 |
| 1.8 | 1753 |

In this embodiment, even in the case where a temperature indicated by the temperature sensor and a temperature of the charging roller are different from each other, a proper peak-to-peak voltage can be set. As a result, a lowering in lifetime of the photosensitive drum and the charging roller can be suppressed, so that an image free from the improper charging can be provided.

Further, when the charging roller including the ion-conductive agent is used, the controller can discriminate that the charging roller temperature is different from the detected temperature in the main assembly. Then, in the case where the controller discriminated that the charging roller temperature was different from the detected temperature in the main assembly, the charging condition is set at the above-described charging condition, so that it is possible to suppress generation of low-temperature fog and a sandy image which are generated in the low-temperature environment.

MODIFIED EMBODIMENTS

In the above-described embodiment, a preferred embodiment of the present invention was described, but the present invention is not limited thereto. Various modifications can be made within the scope of the present invention.

Modified Embodiment 1

In the above-described embodiment, on the basis of the specific frequency acquired from the relationship between the frequency and the alternating current and of the table prepared in advance, the predetermined peak-to-peak voltage applied to the charging means during the image formation was set, but the present invention encompasses the following modified embodiment.

For example, setting can be performed using a charging condition obtained by assigning weights to the peak-to-peak voltage set in the above-described embodiment and the peak-to-peak voltage acquired by making reference to the table A (Table 1) on the basis of the detection temperature in the main assembly. Specifically, the peak-to-peak voltage set in the above-described embodiment is multiplied by 0.9 as weighting coefficient, and the peak-to-peak voltage on the basis of the detection temperature in the main assembly is multiplied by 0.1 as the weighting coefficient, and then an additional value of the resultant values can also be used as the peak-to-peak voltage during the image formation.

Modified Embodiment 2

In the above-described embodiment, the AC voltage applied during the operation in the test mode may also be biased with the DC voltage.

During the operation in the test mode, the AC voltage is applied to the charging roller in a period (time) in which the charging roller rotates at least one full turn at a single frequency.

Further, during the operation in the test mode, the AC voltage is applied to the charging roller in a period (time) in which the photosensitive drum as a rotatable member rotates at least one full turn at a single frequency.

Modified Embodiment 3

In the above-described embodiment, the case where the charging roller included the ion-conductive agent was described, but the present invention is not limited thereto. The present invention is applicable to various charging rollers.

Modified Embodiment 4

In the above-described embodiment, the test peak-to-peak voltage was fixed at 600 V, and the alternating currents were detected while successively changing the frequency. The test peak-to-peak voltage may also be a voltage less than the discharge start voltage and a voltage not less than the discharge start voltage, but may preferably be the voltage less than the discharge start voltage from the viewpoint of suppression of deterioration of the photosensitive member and the charging roller.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2016-203392 filed on Oct. 17, 2016 and 2017-145260 filed on Jul. 27, 2017, which are hereby incorporated by reference herein in their entirety.

What is claimed is:

1. An image forming apparatus comprising:

an image bearing member;

a charging roller configured to electrically charge said image bearing member while in contact with said image bearing member;

a toner image forming portion configured to form a toner image on said image bearing member by depositing toner on said image bearing member after the charged image bearing member is exposed to light;

a voltage source configured to output a voltage in the form of an AC voltage biased with a DC voltage;

a detecting member configured to detect an alternating current flowing between said voltage source and said charging roller;

a controller configured to control said voltage source in an image forming period so that said image bearing member is charged by applying the voltage having a predetermined frequency and a predetermined peak-to-peak voltage from said voltage source to said charging roller and then the toner image is formed on said image bearing member by said toner image forming portion; and a test executing portion configured to execute an operation in a test mode in which in a period in advance of the image forming period, a plurality of test AC voltages having a test peak-to-peak voltage with different frequencies are successively applied to said charging roller and alternating currents are detected by said detecting member, wherein said test executing portion sets the predetermined peak-to-peak voltage on the basis of a specific frequency which is a maximum frequency at which a relationship between the frequencies and the alternating currents acquired in the operation in the test mode maintains linearity.

2. An image forming apparatus according to claim 1, wherein when the relationship between the frequencies and the alternating currents is such that a difference between the relationship maintaining the linearity and the alternating current increases with an increasing frequency, a maximum frequency at which the difference is less than a predetermined value is the specific frequency.

3. An image forming apparatus according to claim 1, further comprising a storing portion in which a correspondence relationship between a value of the specific frequency and a value of the predetermined peak-to-peak voltage is stored in advance, wherein said test executing portion sets the predetermined peak-to-peak voltage on the basis of the correspondence relationship stored in said storing portion.

4. An image forming apparatus according to claim 1, wherein when said test executing portion successively applies the plurality of AC voltages with the different frequencies, said test executing portion applies the AC voltages in an increasing order of the frequencies.

5. An image forming apparatus according to claim 1, wherein when said test executing portion successively applies the plurality of AC voltages having the different frequencies, said test executing portion once applies the AC voltages in an order from a low frequency to a high frequency and then applies the AC voltage having the low frequency.

6. An image forming apparatus according to claim 1, wherein said charging roller contains an ion-conductive agent.

7. An image forming apparatus according to claim 1, wherein the test peak-to-peak voltage has a value at which electric discharge does not generate between said image bearing member and said charging roller.

8. An image forming apparatus according to claim 1, wherein said test executing portion applies each of the test AC voltages to said charging rollers for a time in which said charging roller rotates at least one full turn.

9. An image forming apparatus according to claim 1, wherein said image bearing member is a rotatable member, and wherein said test executing portion applies each of the test AC voltages to said charging roller for a time in which said charging roller rotates at least one full turn.

10. An image forming apparatus according to claim 1, further comprising a main assembly and a temperature detecting member configured to detect a temperature of said main assembly.

* * * * *